US006780100B1

(12) United States Patent
Gretz

(10) Patent No.: US 6,780,100 B1
(45) Date of Patent: Aug. 24, 2004

(54) DRYER VENT MOUNTING BLOCK

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

(21) Appl. No.: 10/456,028

(22) Filed: Jun. 7, 2003

(51) Int. Cl.[7] ..... F23L 17/02
(52) U.S. Cl. ..... 454/359; 34/235; 248/909
(58) Field of Search ..... 454/353, 359, 454/360; 34/235; 248/906, 904; 126/299 R, 299 D

(56) References Cited

U.S. PATENT DOCUMENTS 4,858,591 A * 8/1989 Fu ..... 126/299 D
5,303,522 A * 4/1994 Vagedes ..... 52/97
5,328,212 A * 7/1994 Kosik et al. ..... 285/42
5,472,241 A * 12/1995 Kosik et al. ..... 285/42
5,482,507 A * 1/1996 Priest ..... 454/359
5,549,266 A * 8/1996 Mitchell et al. ..... 248/205.1
5,722,181 A * 3/1998 Meyer ..... 34/235
6,378,227 B1 * 4/2002 Bradford ..... 34/235
2003/0136060 A1 * 7/2003 Bonshor ..... 52/97

* cited by examiner

*Primary Examiner*—Harold Joyce

(57) ABSTRACT

A dryer vent outlet hood mounting device comprising a mounting block portion having a central opening, an interior peripheral wall about the central opening and a pair of planar, generally rectangular, peripheral flanges extending at right angles from and joined to the interior peripheral wall to define a peripheral channel for the receipt of siding, and a dryer vent outlet hood mounted on the exterior surface of one of the peripheral flanges. The central opening may include a central circular aperture for engagement with a dryer vent tube. The mounting block may include a variety of nailing members as well as the incorporation of a variety of score lines that permit adjustment of the size of the mounting block portion for adaptation to a variety of new and retrofit siding configurations. The dryer vent hood may also incorporate openable louvers and a bird or insect impermeable mesh over its outlet.

4 Claims, 3 Drawing Sheets

DRYER VENT MOUNTING BLOCK

FIELD OF THE INVENTION

The present invention relates to a combination mounting block/dryer vent outlet hood for mounting on the exterior of a structure.

BACKGROUND OF THE INVENTION

In the mounting of dryer vent outlets of the exterior of structures, particularly those sided with any of a variety of sidings, a problem exists with obtaining a weather/water proof seal between the back surface of the vent outlet hood or other configuration and the side of the structure. In many installations, the rear surface of the dryer vent outlet or hood must be applied to the structure over a junction between two pieces of, for example, lapped siding. Since the rear surface of the dryer vent hood or outlet is normally planar, it is normally applied directly over the junction or tilted to lie flat against the upper of the two pieces of lapped siding. Either of these two methods of installation results in; 1) an unsightly installation; or 20 an installation that allows for the entry of water coming down the side of the structure. Even when, in the latter case, caulk or other sealant is applied to the joint between the dryer vent hood and the siding to limit the infiltration of water, the dryer vent hood or outlet is normally in an unsightly tilted upward position and not horizontal as it was designed, and the caulking or sealant ultimately shrinks, cracks or otherwise deteriorates so that water can enter between the rear surface of the dryer vent outlet or hood and the exterior surface of the structure. Such infiltration of water often results in deterioration of the siding about the lower edge of the dryer vent hole that has been bored into the siding.

It would thus be highly desirable to have a dryer vent outlet or hood that incorporated a mounting block that appropriately and properly engaged the siding and provided a planar surface for the attachment of the dryer vent hood or outlet or incorporated the dryer vent outlet or hood as an integral member thereof.

Mounting blocks for the application of, for example, electric meters, exterior electrical fixtures and the like to sided structures are commonly commercially available and provide both aesthetically acceptable and planar attachment surfaces for such devices while properly engaging the siding on the structure to which the meter or electrical fixture is to be applied. Such mounting blocks provide a means of securing such devices to the side of a sided structure while permitting waterproof attachment of such devices.

OBJECTIVE OF THE INVENTION

It is therefore an object of the present invention to provide a dryer vent outlet mounting device that permits planar, aesthetically pleasing and waterproof attachment of a dryer vent outlet to a structure that is sided in one fashion or another.

SUMMARY OF THE INVENTION

According to the present invention there is provided a dryer vent outlet hood mounting device comprising a mounting block portion having a central opening, an interior peripheral wall about the central opening and a pair of planar, generally rectangular, peripheral flanges extending at right angles from and joined to the interior peripheral wall to define a peripheral channel for the receipt of siding, and a dryer vent outlet hood mounted on the exterior surface of one of the peripheral flanges. The central opening may include a member incorporating a central circular aperture for engagement with a dryer vent tube. The mounting block may include a variety of nailing members as well as the incorporation of a variety of score lines that permit adjustment of the size of the mounting block portion for adaptation to a variety of new and retrofit siding configurations. The dryer vent hood may also incorporate openable louvers and a bird or bug impermeable mesh over its outlet

DETAILED DESCRIPTION

Figure 1:
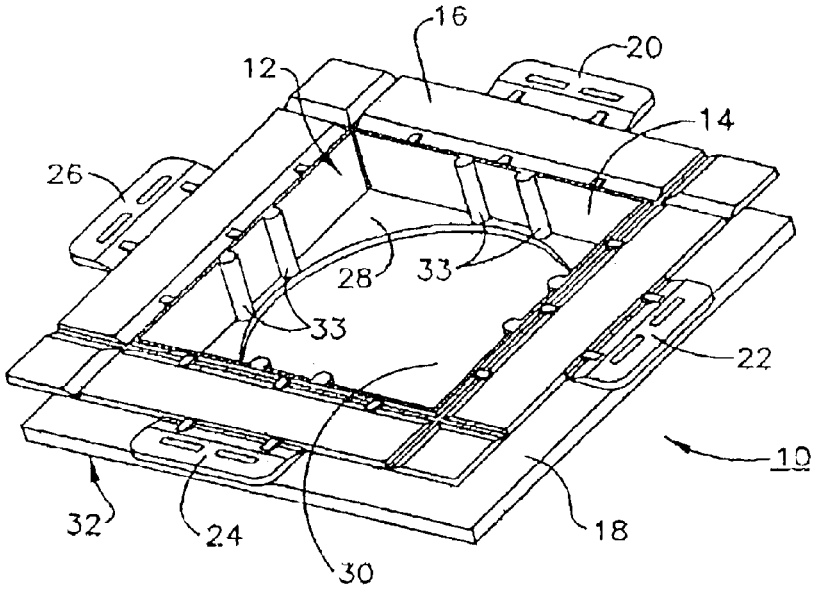
FIG. 1 is a rear/interior perspective view of the mounting block portion of the dryer outlet mounting device of the present invention.
Figure 2:
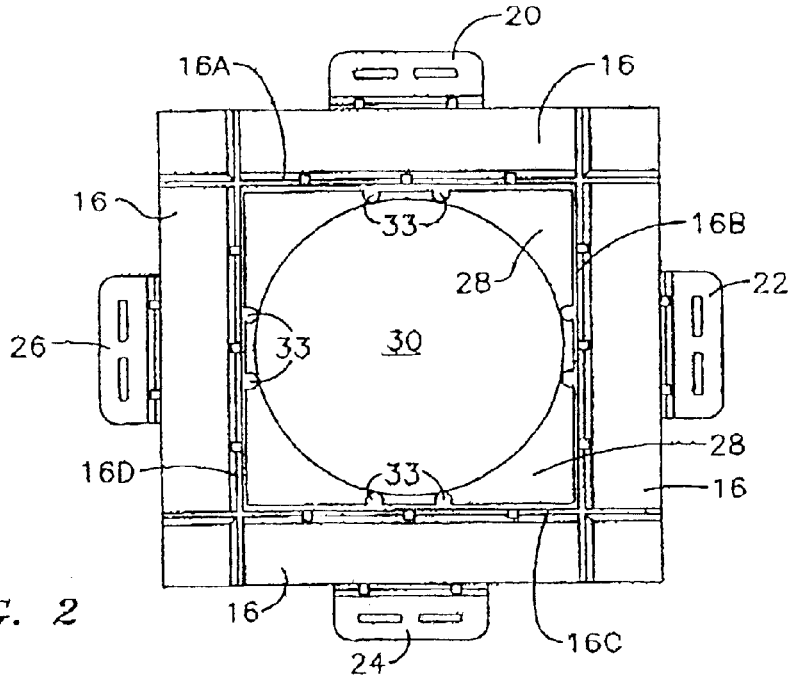
FIG. 2 is a rear/interior view of the mounting block portion of the dryer outlet mounting device of the present invention.
Figure 3:
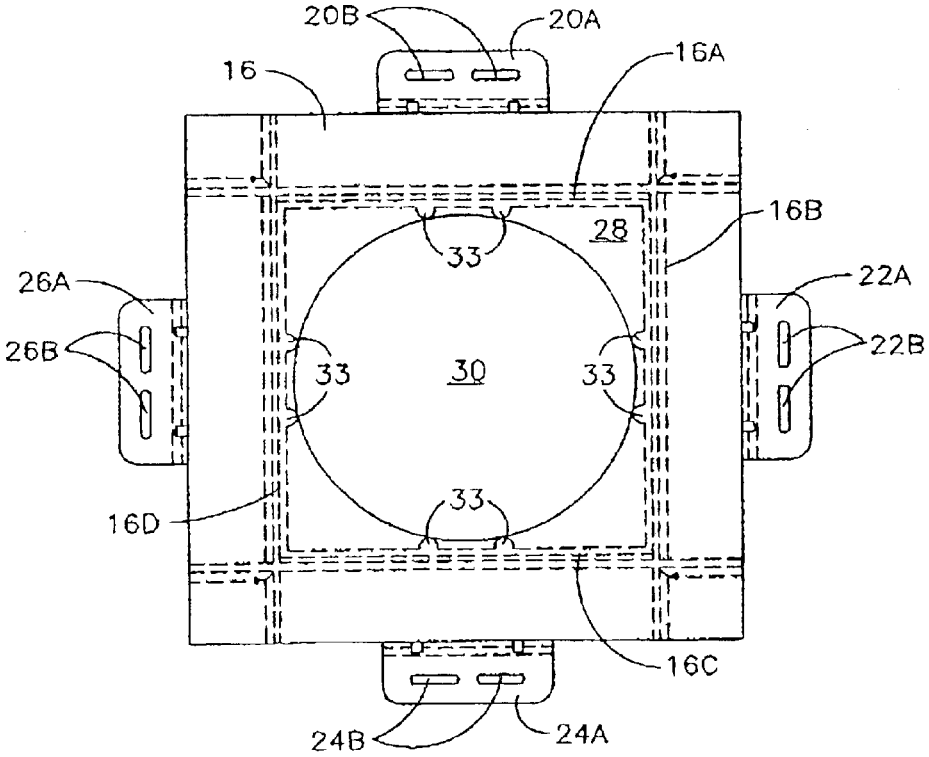
FIG. 3 is a partially phantom front view of the mounting block portion of the dryer outlet mounting device of the present invention.

Referring now to FIG. 1, the mounting block portion of the combined dryer vent outlet mounting device 10 of the present invention comprises a central opening 12 defined by a peripheral wall 14. Extending at approximately right angles from peripheral wall 14 at its opposing extremities is a pair of lateral flanges 16 and 18. Flange 16 is referred to hereinafter as the interior flange at it is the flange that is placed toward or adjacent the structure at installation and flange 18 is referred to hereinafter as the exterior flange as it is the flange that addresses the exterior in relationship to the structure upon installation. According to a desirable embodiment of the mounting block portion 10 of the device of the present invention includes nailing tabs 20, 22, 24, and 26 that are attached to interior flange 16. Nailing tabs 20, 22, 24 and 26 include score lines 20A, 22A, 24A and 26A (best seen in FIG. 3) that permit their ready removal in those installations where they are not required. Nailing flanges 20, 22, 24 and 26 include apertures 20B, 22B, 24B and 26B that permit the insertion of nails or screws for attachment of mounting block portion 10 to the wall of a structure. Additionally, interior flange 16 is provided about the periphery of central opening 12 with score lines 16A, 16B, 16C and 16D (best seen in FIG. 3) that allow for the removal of interior flange 16 in retrofit applications where the presence of interior flange 16 would inhibit insertion of interior flange 16 into an aperture cut into the siding of a structure. Included within central aperture 12 is dryer tube orientation plate 28 that is integrally formed with peripheral wall 14 and substantially coplanar with exterior surface 32 of exterior flange 18. At the center of dryer vent tube orientation plate 28 is a circular aperture 30 that allows insertion of a dryer vent tube as described more fully below in connection with FIG. 5. Reinforcing members 33 may be included to "rigidize" mounting block 10.

Mounting block 10 is designed for application to the wall of a structure by either, in the case of new construction or residing, the application of nails or screws through apertures 20A, 20D, 20C and 20D, or in the case of retrofit installation removal of interior peripheral flange 6 by fracturing along score lines 16A, 16B, 16C and 16D and insertion of the remaining portions of mounting block 10 into a rectangular opening cut into siding already on the structure and the application of fasteners such as nails or screws through dryer vent tube orientation plate 28 to attach mounting block 10 to the underlying wall of the structure.

Figure 5:
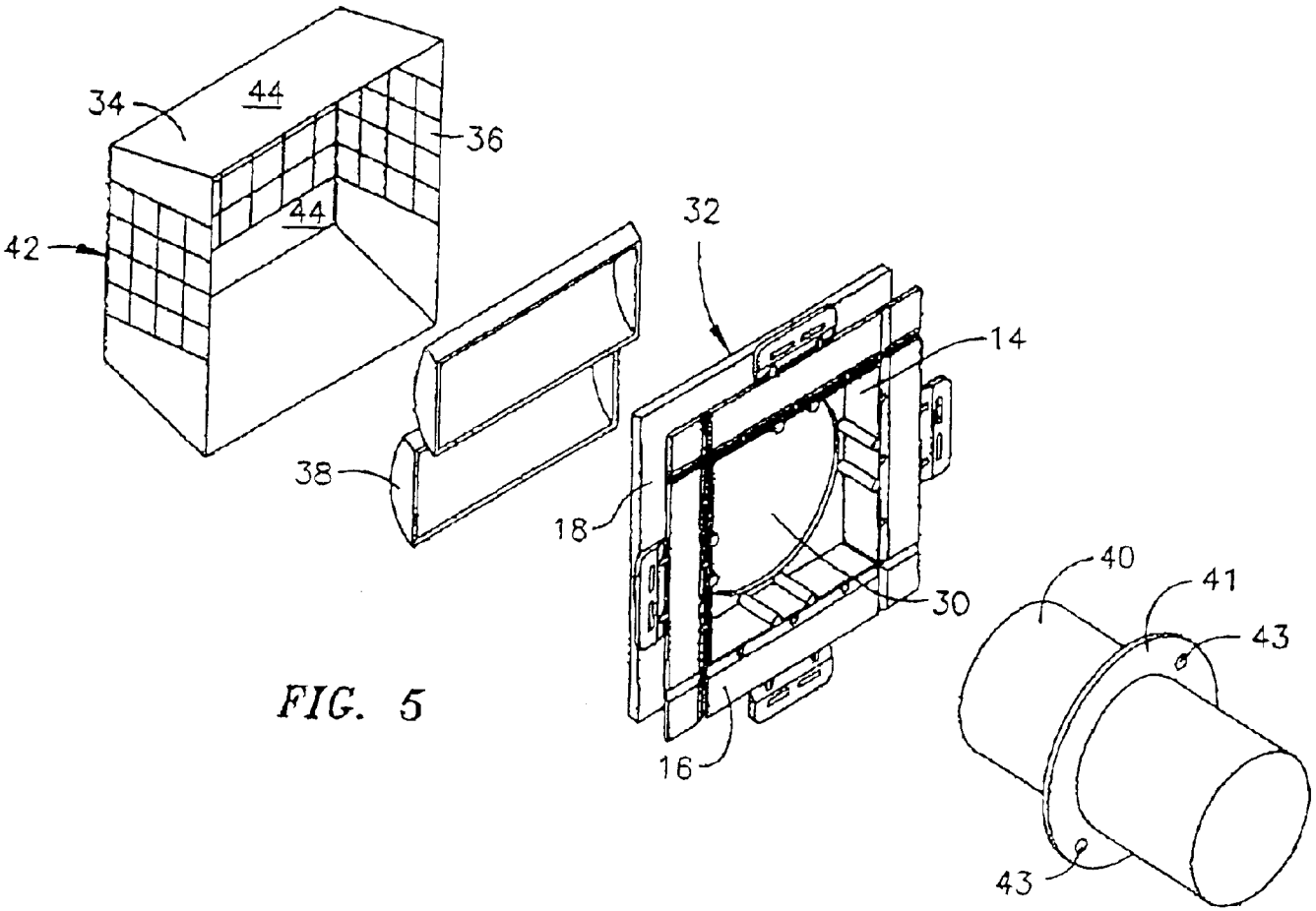
FIG. 5 is an exploded view of the combined dryer vent outlet mounting device of the present invention showing certain additional optional elements as well as the terminal end of a dryer vent tube to which the device of the present invention is connected.

Referring now to FIG. 5, the final element of the dryer vent outlet mounting device of the present invention comprises a dryer vent outlet hood 34 that is attached to or integrally formed with dryer vent tube orientation plate 28 or surface 32 at or in the vicinity of peripheral wall 14. Dryer vent outlet hood 34 may be attached either by adhesion with a suitable adhesive, by welding of the two mating surfaces or by any of a wide variety of snap in connections that are readily and commonly available and are well known to the skilled artisan. The manner of attachment of dryer vent outlet hood 34 is not of particular importance to the substance of the invention. It is preferred, however, that whatever method of attachment is utilized in this connection, it be "removable", i.e. dryer vent outlet hood 34 can be removed from mounting block 10, so that replacement thereof is relatively easy, as it is relatively common for dryer vent outlet hood 34 to deteriorate due to sunlight, weather and the like prior to any deterioration of mounting block portion 10.

Figure 4:
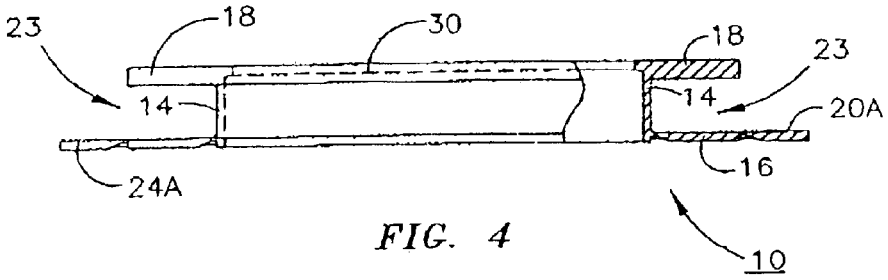
FIG. 4 is a side view of the mounting block portion of the dryer outlet mounting device of the present invention.

Referring now to FIG. 4 that depicts a side view of mounting block portion 10, interior flange 16 and exterior flange 18 in combination with peripheral wall 14 define a channel 23 for the receipt of siding when mounting block 10 is applied to the wall of a structure.

As shown in FIG. 5, a dryer vent tube 40 exiting from inside of the structure and attached at its remote end to the dryer (not shown) is inserted into circular aperture 30 upon installation to permit access of air exiting dryer vent tube 40 to dryer vent outlet hood 34 and thence to the exterior of the structure. Dryer vent tube 40 is commonly mounted in a collar 41 that is attached to the structure through the application of fasteners through apertures 43 and into the wall of the underlying structure.

As further depicted in FIG. 5, dryer vent outlet hood 34 includes a bird/insect repelling mesh 36 that prevents insects and birds from infiltrating dryer vent outlet hood 34. While in FIG. 5, the air removal opening 42 in dryer vent outlet hood 34 is shown in the horizontal position, it will be readily apparent to the skilled artisan that this element may be oriented in a downward or vertical position with bird/insect repelling mesh 36 facing downward and the entire upper exterior surface 44 of dryer vent outlet hood 34 being solid or fully enclosed.

Additionally, as shown in FIG. 5, a set of louvers 38 that rotate to an open position upon the application of positive pressure air applied by the exit of elevated pressure air caused by the dryer blower may also be included at the interior of dryer vent outlet hood 34 to provide an insulating property to hood 34 to inhibit, at least minimally, the infiltration of outside air into dryer vent tube 40.

While the combined mounting block/dryer outlet vent hood of the present invention may be fabricated from a variety of materials, it is preferred that it be fabricated from a polymeric material such as poly(vinyl chloride) or the like by a high production rate process such as injection molding.

As the invention has been described, it will be apparent to those skilled in the art that the same may be varied in many ways without departing from the spirit and scope of the invention. Any and all such modifications are intended to be included within the scope of the appended claims.

What is claimed is:

1. A dryer vent outlet hood mounting device comprising:

A) a mounting block portion having a central opening;

B) an interior peripheral wall about the central opening, the interior peripheral wall having opposed extremities;

C) spaced apart interior and exterior planar and generally rectangular, peripheral flanges each extending at right angles from and joined to an opposing extremity of the interior peripheral wall to define a peripheral channel for the receipt of siding, the exterior peripheral flange having an exterior surface remote from the interior flange, the interior flange having score lines in the approximate region of the interior peripheral wall to allow for removal of the interior peripheral flange;

D) a dryer vent outlet hood removably mounted on the exterior surface of the exterior peripheral flange and including an air removal opening therein; and E) a central circular aperture within the central opening for engagement with a dryer vent tube and permitting access to the air removal opening by air ejected from the dryer vent tube.

2. The dryer vent outlet hood mounting device of claim 1 wherein the exterior peripheral flange has an outer edge and further including nailing flanges extending from the outer edge.

3. The dryer vent outlet hood mounting device of claim 1 wherein the dryer vent outlet hood further includes a bird/insect repellent mesh over the air removal opening.

4. The dryer vent outlet hood mounting device of claim 1 further including louvers that rotate to permit the passage of air when positive pressure is applied thereto from the direction of the interior peripheral flange and close to inhibit the passage of air in the absence of such positive pressure.

* * * * *